US009316364B2

(12) United States Patent
Halliburton et al.

(10) Patent No.: US 9,316,364 B2
(45) Date of Patent: Apr. 19, 2016

(54) ILLUMINATION DEVICE FOR A BALLOON

(75) Inventors: James Halliburton, Cheshire (GB); Tony Rhoades, Cheshire (GB); Sean Tisdall, Cheshire (GB)

(73) Assignee: SEATRIEVER INTERNATIONAL HOLDINGS LIMITED, Lostock Gralam, Northwich (GB)

( * ) Notice: Subject to any disclaimer, the term of this patent is extended or adjusted under 35 U.S.C. 154(b) by 330 days.

(21) Appl. No.: 14/127,335

(22) PCT Filed: Jun. 19, 2012

(86) PCT No.: PCT/GB2012/051404

§ 371 (c)(1), (2), (4) Date: Jan. 16, 2014

(87) PCT Pub. No.: WO2012/175945

PCT Pub. Date: Dec. 27, 2012

(65) Prior Publication Data

US 2014/0168960 A1 Jun. 19, 2014

(30) Foreign Application Priority Data

Jun. 21, 2011 (GB) ..... 1110437.9

(51) Int. Cl.
*F21L 4/00* (2006.01)
*A63H 27/10* (2006.01)

(52) U.S. Cl.
CPC . *F21L 4/00* (2013.01); *A63H 27/10* (2013.01); *A63H 2027/1058* (2013.01)

(58) Field of Classification Search
CPC ... F21L 4/00; A63H 27/10; A63H 2027/1058
See application file for complete search history.

(56) References Cited

U.S. PATENT DOCUMENTS 7,147,536 B1 12/2006 Hartelius
2015/0009656 A1* 1/2015 Chen ..... A63H 27/10 362/157

FOREIGN PATENT DOCUMENTS

| | | |
|---|---|---|
| DE | 30 15 962 | 11/1981 |
| EP | 1 600 690 | 11/2005 |
| WO | 01/41893 | 6/2001 |
| WO | 2008/110832 | 9/2008 |
| WO | 2011/095788 | 8/2011 |

OTHER PUBLICATIONS

PCT/GB2012/051404 International Search Report and Opinion.
PCT/GB2012/051404 International Preliminary Report on Patentability.
GB1110437.9 Search Report.

* cited by examiner

*Primary Examiner* — David V Bruce
(74) *Attorney, Agent, or Firm* — Notaro, Michalos & Zaccaria P.C.

(57) ABSTRACT

An illumination device for mounting inside a balloon comprises a light source, such as LED, and a battery power source for the light source, both mounted in a housing. The housing is provided as an inner part of a first plastics material in which the battery power source is housed and an outer casing of a second plastics material, which at least partially surrounds the inner part and provides a cover for the light source. The second plastics material is transparent and resiliently deformable and may be a thermoplastics elastomer. In preferred embodiments the housing is provided as a one-piece unit which is a co-molding of the first plastics material and the second plastics material, and which is provided as two mating sections hingedly connected to each other.

18 Claims, 6 Drawing Sheets

ILLUMINATION DEVICE FOR A BALLOON

FIELD OF INVENTION

The present invention concerns an illumination device for mounting inside a balloon formed by a wall of flexible material which is at least partially transparent or translucent, the illumination device comprising a housing and a light source and a battery power source for the light source both mounted inside the housing.

BACKGROUND ART

The applicant's earlier patent specification WO 2008/110832 discloses a party balloon, that is to say a toy balloon, having an illumination device mounted inside, the illumination device comprising a light emitting diode (LED) powered by at least one battery. The LED lights up when a strip of insulating material is withdrawn from between the battery and the LED to complete the circuit and the balloon is thereby illuminated from its interior.

In the applicant's known party balloon the illumination device is mounted to the inside of the balloon wall by having a projection which is engaged from outside the balloon by an attachment element, such as a clip or a band, more specifically an O-ring of elastic material. Projections in the form of a partially spherical button or, more preferably, a flattened button, that is to say a pin with a neck and a flattened head, were proposed.

Although the applicant's earlier specification is primarily concerned with a balloon formed in one piece of elastomeric material, such as latex, the manner of mounting the illumination device inside the wall by means of a projection engaged from outside by a clip or band or similar is also applicable to a balloon formed from two sheets of flexible material connected around their edges, the sheeting being formed of substantially inelastic material, such as metallised plastics material or Mylar.

Other means of mounting an illumination device to the wall of a balloon are possible. For example the device may be attached by adhesive when the balloon wall material is of the substantially inelastic type. The present invention is also applicable to all such embodiments.

Typically it is intended that the illumination device should only operate once the balloon is inflated so as to light up the inflated balloon.

In the event that the balloon bursts when inflated, the illumination device which has been mounted inside may be flung out at some speed. There is a risk, albeit slight, that the device may impact a person in the vicinity, causing pain or injury.

OBJECT OF THE INVENTION

An object of the present invention is to reduce impact force of any projectile formed by a flying or falling illumination device resulting from a bursting balloon.

SUMMARY OF THE INVENTION

The present invention provides an illumination device for mounting inside a balloon formed by a wall of flexible material which is at least partially transparent or translucent, the illumination device comprising a housing, and a light source and a battery power source for the light source mounted within the housing, characterised in that the housing is provided as an inner part of a first plastics material in which the battery power source is housed and an outer casing of a second plastics material which at least partially surrounds the inner part and provides a cover for the light source, the second plastics material being transparent and being resiliently deformable.

The resilience/deformability of the plastics material used for the outer casing reduces the energy of impact in the event that the illumination device is flung out upon bursting of the inflated balloon, thus reducing risk of damage or injury if it strikes an object or person.

In preferred embodiments of the invention the housing is provided as at least one co-moulding of the first plastics material and the second plastics material. It is preferred that the housing is provided as a one-piece unit. This reduces the number of component parts and thereby simplifies assembly of the device and reduces cost of its production.

BRIEF DESCRIPTION OF THE DRAWINGS

The invention will be described further, by way of example, by reference to the accompanying drawings of a specific practical embodiment in which.

DETAILED DESCRIPTION OF PREFERRED EMBODIMENT

Figure 8:
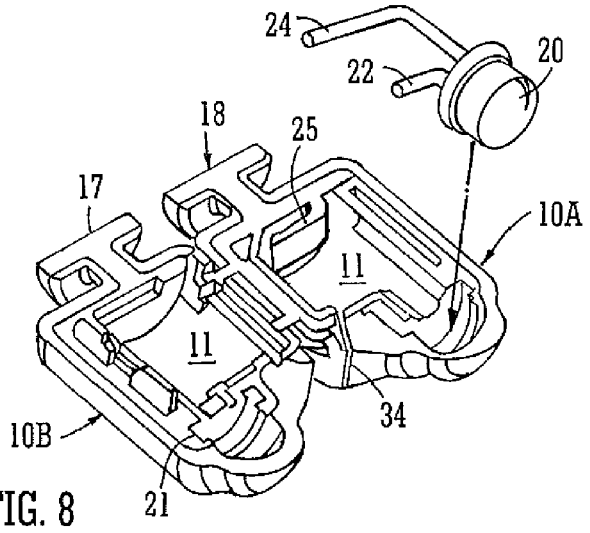
FIGS. 8, 9 A, B, C, 10 and 11 show the sequence of operations in assembly of the device.
Figure 9A:
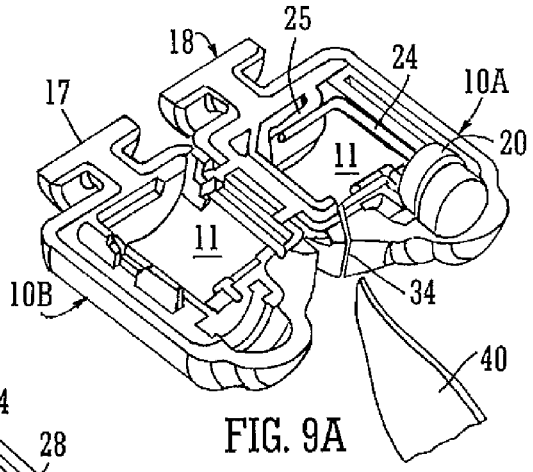
Figure 9B:
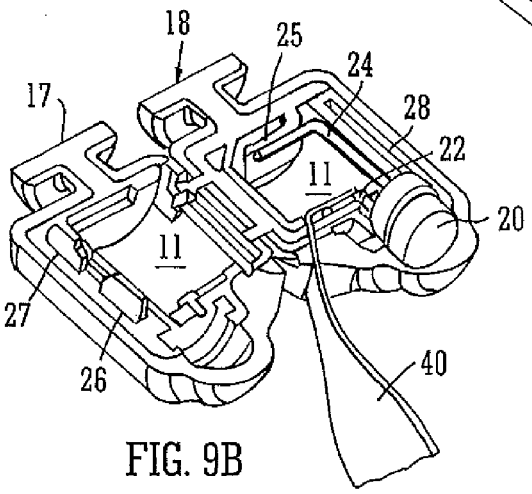
Figure 9C:
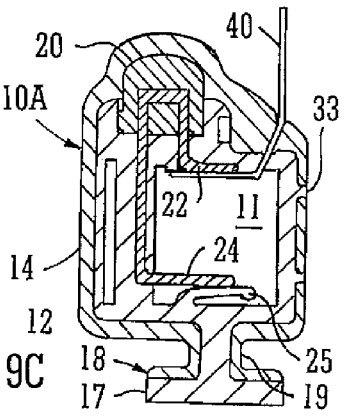
Figure 10:
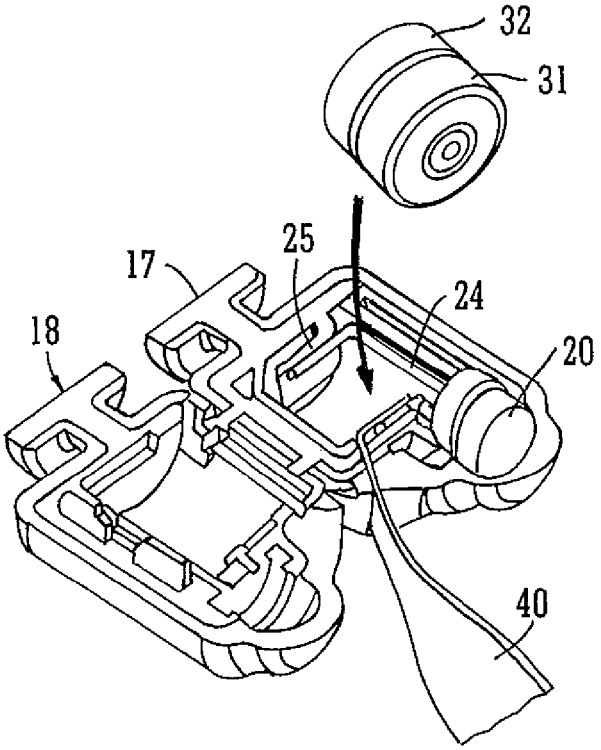
Figure 11:
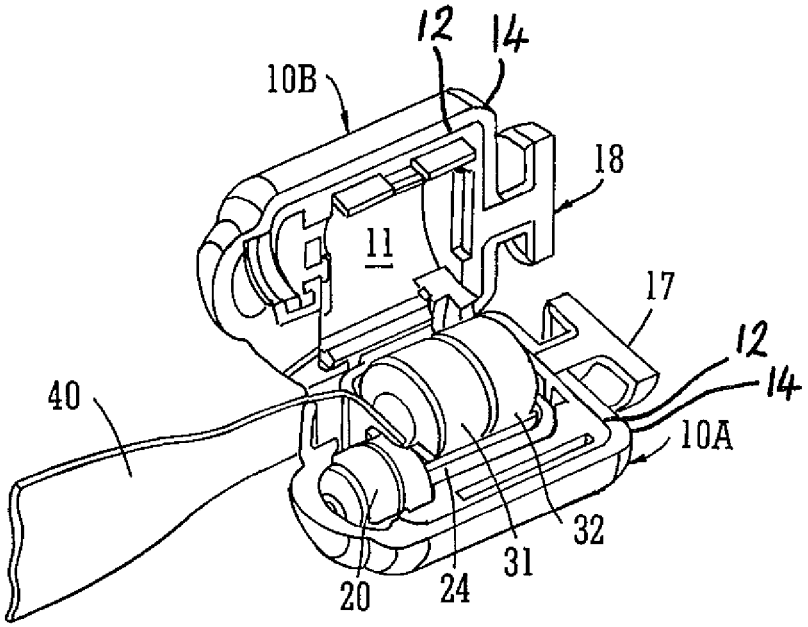
Figure 12:
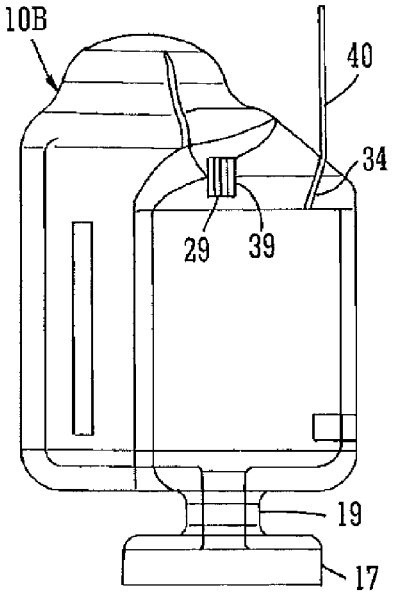
FIG. 12 is a front view of the assembled device, with the pull tab only partially shown.
Figure 13:
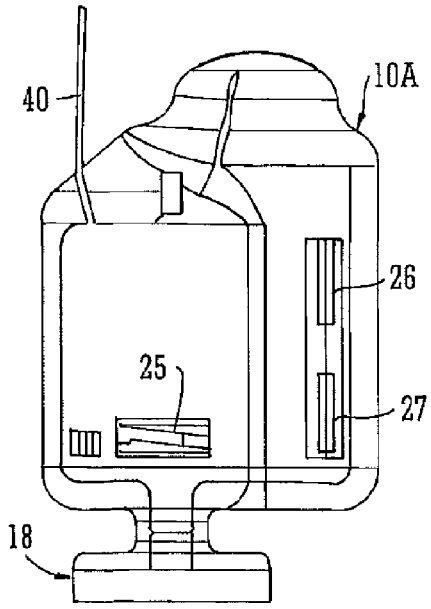
FIG. 13 is a corresponding rear view of the assembled device.
Figure 14:
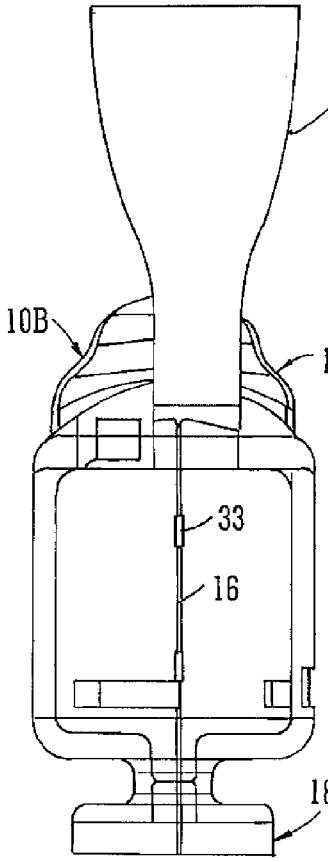
FIG. 14 is a corresponding side view, viewed from the right of FIG. 12, of the assembled device, again with the pull tab shown only partially.
Figure 15:
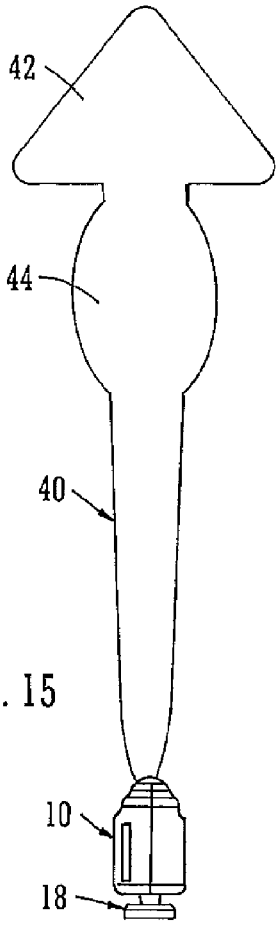
FIG. 15 is a reduced scale side view, corresponding to FIG. 14, so as to include the full pull tab and indicate its size in relation to the housing.
Figure 16:
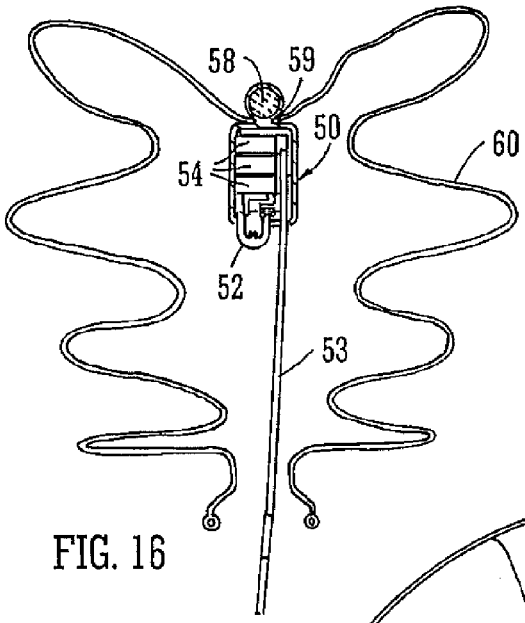
FIGS. 16 and 17 are schematic drawings of the previously mentioned prior art illumination device mounted inside the balloon prior to and after inflation, respectively.
Figure 17:
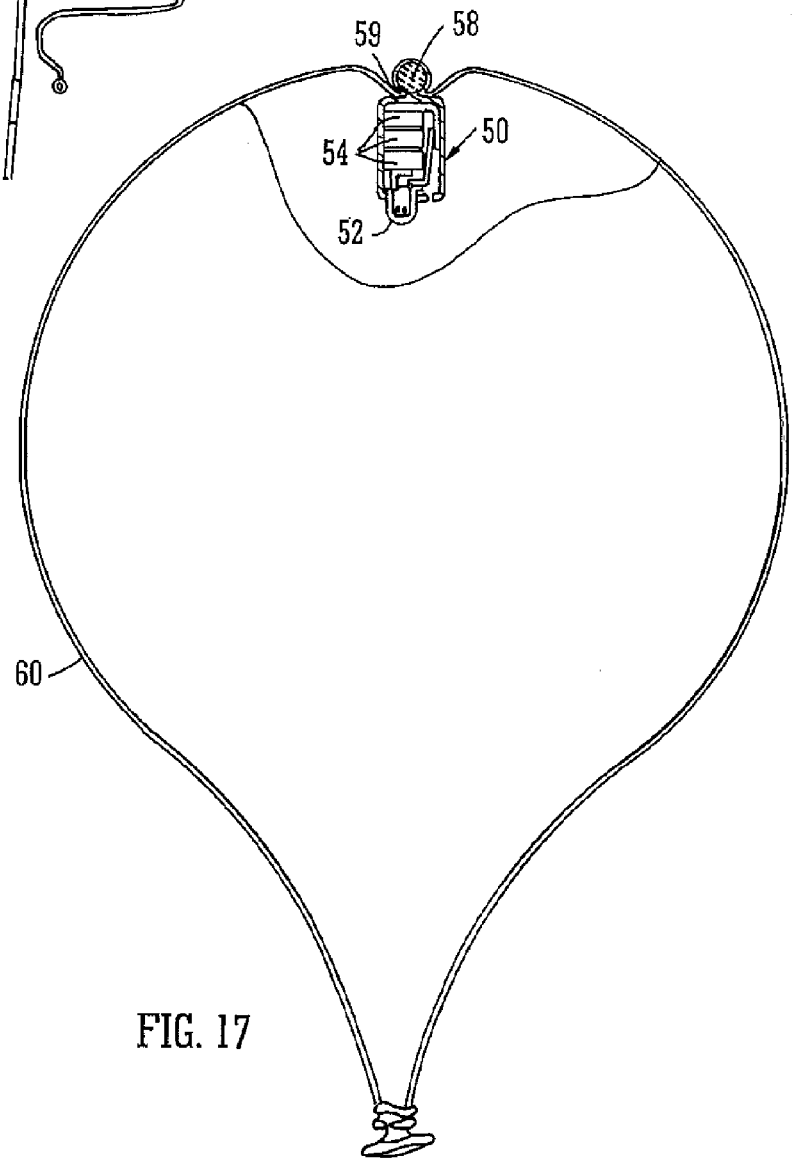

With reference to the drawings, a preferred practical embodiment of the illumination device of the invention comprises four separate parts for assembly, namely:

- a co-moulded one-piece housing 10, as shown in FIGS. 1 to 4;
- a light emitting diode (LED) 20 provided with contact members 22, 24, best shown in FIG. 8, but also appearing in FIGS. 9 to 11;
- two button cell batteries 31, 32, shown in FIGS. 10 and 11; and
- a strip of insulating material 40, shown partially in FIGS. 9 to 14, and only fully in FIG. 15.

The housing 10 is formed with an integral projection 18 having a neck 19 and an enlarged head 17 by means of which the housing is to be mounted inside a balloon (not shown) by an elastic band (not shown) engaging from outside the balloon wall around the neck 19 of the projection 18. The head 17 is in the form of a flattened button, ie. a generally circular disc. The projection 18 is, accordingly, T-shaped in cross-section. The strip 40 of insulating material is initially located so that a portion of said strip 40 extends between the battery power source 31, 32 and one contact member 22 of the LED 20. In the fully assembled device, as shown in FIGS. 12 to 15, the strip 40 extends out of the housing 10 as a pull tab. When this is pulled out, the LED 20 is connected to the batteries 31, 32 and lights up. When the device 10 is mounted into the initially uninflated balloon, the pull tab 40 extends out of the neck of the balloon. It has an enlarged arrow-shaped end region 42 which remains outside the neck of the balloon and provides suitable means for manual gripping and pulling by an end user who is to inflate and illuminate the balloon. An additional enlarged region 44 spaced from the arrow-shaped end region 42 is provided to lodge in the neck region of the initially uninflated balloon to hold the pull tab in position and minimise risk of its inadvertent pulling out or removal by other means during storage and transport between balloon assembly and final use.

As illustrated in FIGS. 1 to 4, the housing 10 is formed in one piece as two mating sections 10A, 10B of generally similar but not identical configuration. The housing is a co-moulding of a first plastics material, typically polypropylene, providing an inner part 12, and a second plastics material, such as a thermoplastic elastomer, providing an outer casing 14. The first plastics material has greater rigidity than the second material. The second material is resiliently deformable.

Figure 1:
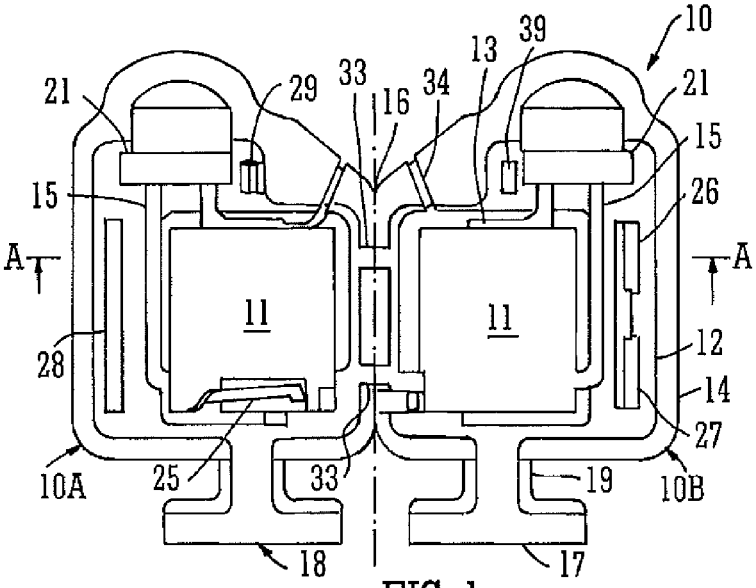
FIG. 1 is a plan view of the co-moulded housing of the illumination device in its initial open condition.
Figure 2:
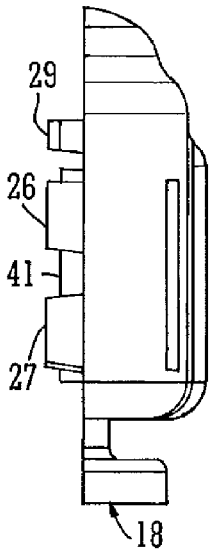
FIG. 2 is a side view as viewed from the right in FIG. 1.
Figure 3:
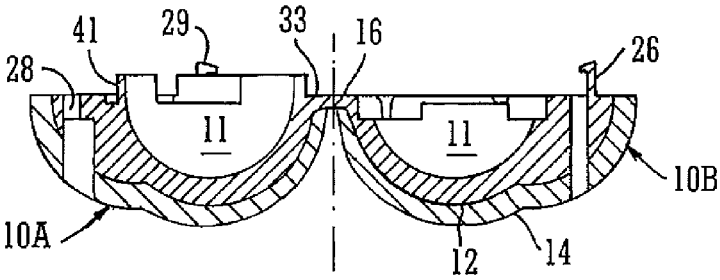
FIG. 3 is a cross-section along line A-A in FIG. 1.
Figure 4:
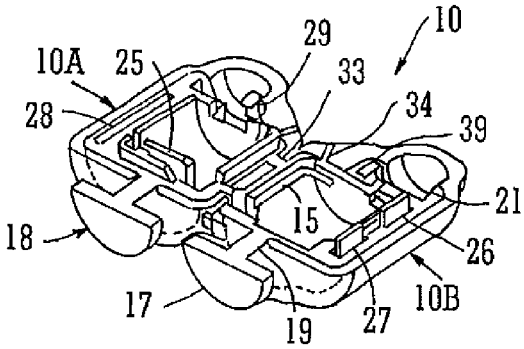
FIG. 4 is a perspective view of the co-moulded housing of FIGS. 1 to 3.

As best shown in FIGS. 1, 3 and 4, both the inner part 12 and the outer casing 14 form parts of the respective mating sections 10A, 10B and parts of a hinge connection 16 between these sections. Thus both the first plastics material of the inner part 12 and the second plastics material of the outer casing 14 provide part of each of the mating sections 10A, 10B of the main housing which provides an enclosure for the LED 20 and the batteries 31, 32, and also part of the projection 18, substantially one half of which is formed by each of the mating sections 10A, 10B. However, in modified embodiments the first, more rigid and less expensive material may provide the entire projection 18.

The inner part 12 provides a receptacle 11 for the batteries 31, 32, guide channels 13, 15 for reception of the LED contact elements 22, 24 and a receptacle 21 for a lower part of the LED from which the contact elements extend. The inner part 12 is moulded with an integral spring element portion 25 in the manner of a leaf spring. This integral spring element 25 is at an end of the battery receptacle 11 remote from the LED receptacle 21 and is formed in only one of the mating sections 10A of the housing. The same mating section 10A has its inner part 12 of larger size than that of the other mating section 10B, thereby forming an upstand 41 protruding above the mating edge of the respective outer casing 14 of that mating section 10A, as shown in FIG. 3. Accordingly, this mating section 10A accommodates more than half the cross-sectional area of the cylindrical shape of the button cell batteries 31, 32 such that in the assembly process they clip into position and are retained.

The inner part 12 includes strips of material 33 configured to provide part of the hinge connection 16 between the two mating parts 10A, 10B. Again, in modified embodiments the inner part 12 could provide the entirety of the hinge connection 16.

The inner part 12 is also formed with latch projections and co-acting engagement recesses on the respective mating sections 10A, 10B. There are two latch projections 26, 27 along the open side of the section 10B with a co-operating recess 28 formed in the section 10A. Additionally there is a further latch projection 29 near the LED recess 11 of the mating section 10A and a co-operating recess 39 in the section 10B.

The outer casing 14 is of transparent plastics material. A suitable plastics is a thermo plastic vulcanizate TPV. As mentioned, this plastics material is resiliently deformable. It preferably has a co-efficient of restitution in the range 0.4 to 0.6

The second plastics material of the outer casing surrounds, as an outer shell, all of the inner part, in both mating sections 10A, 10B, and at the hinge connection 16, with the sole exception of the projection 18, where the head 17 is covered only on its underside facing the main housing (or optionally not at all in a modified embodiment). This is appropriate as there is no need for full enclosure of the head 17. It saves on the more expensive TPV material and simplifies the moulding production process. Also, the application of the elastic band when the device is subsequently mounted to the balloon wall may be facilitated with a projecting head which is predominantly of the substantially rigid first plastics material making it easier to grip and hold.

The outer casing 14 completes the receptacle for the LED 20, for which it provides a transparent cover.

Figure 5:
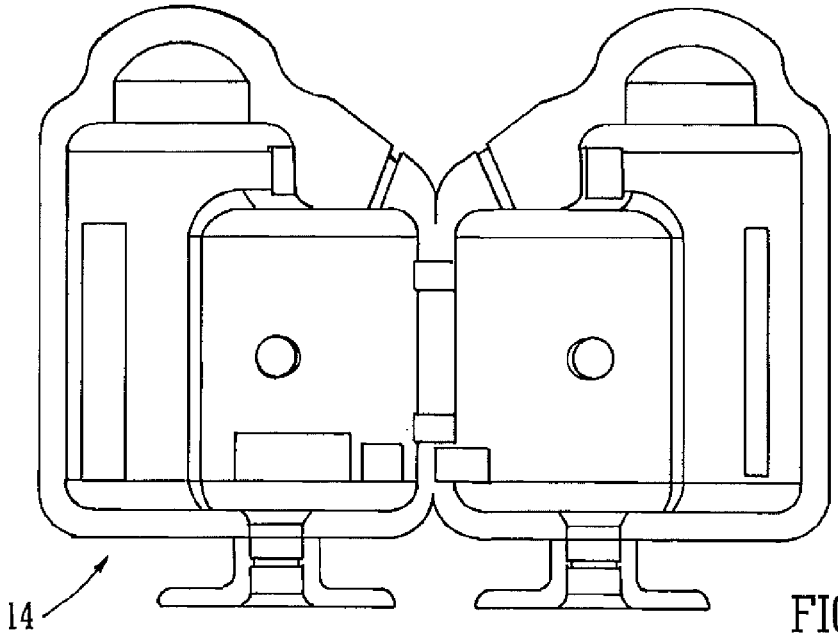
FIG. 5 is a plan view of the outer casing only of the housing of FIG. 1, for comparison with FIG. 1.
Figure 7:
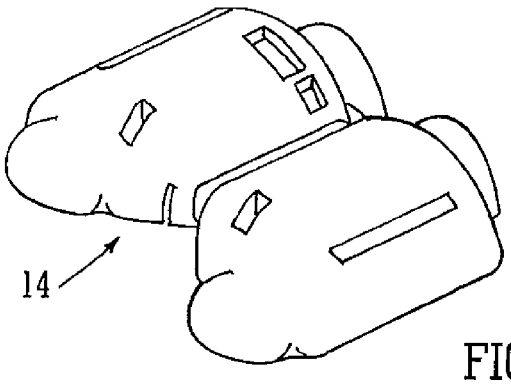
FIG. 7 is a perspective view of the outer casing of the housing shown in FIGS. 5 and 6, but turned over to show its external contour.
Figure 6:
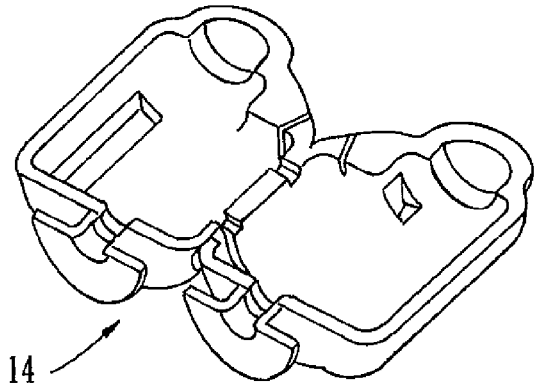
FIG. 6 is a perspective view of the outer casing only of the housing, for comparison with FIG. 4.

The overall configuration of the outer casing 14 above is shown for purposes of illustration only in FIGS. 5, 6 and 7 so that this can be contrasted with the co-moulding 12, 14 of FIGS. 1 to 4. However, it will be understood that in practice in preferred embodiments of the invention the outer casing 14 is not actually produced as a separate part as the inner and outer parts 12, 14 are produced at the same time in a co-moulding process. However, in a less preferred production process, in other embodiments, the housing inner and outer parts 12, 14 could be produced separately, then assembled together afterwards.

A typical thickness for the material of the outer casing 14 is in the range 0.5 mm to 1.0 mm.

Each of the mating sections 10A, 10B has a narrow slot 34 cut in from the open, mating edge, extending through both the outer casing 14 and the inner part 12 from the exterior to the battery receptacle 11 at a location between the hinge connection and the LED receptacle 21. However, in modified embodiments such a slot 34 may be provided only in the mating section 10A which provides the spring element 25, and/or in a different location.

The LED 20, as shown in FIG. 8, has its first contact element 22 of shorter length and bent laterally and its second contact element 24 of longer length and bent in an L shape to provide a distal limb parallel with the first contact 22.

The steps in the assembly of the components to form the completed illumination device are illustrated in FIGS. 8 to 11.

First, as shown in FIG. 8 with the housing 10 in its open disposition, as produced from the co-moulding process, the LED 20 with its pre-bent contact elements 22, 24 is placed into section 10A.

The LED 20 is a snug fit into the receptacle half provided by this section 10A and the contact elements 22, 24 locate in the guide channels 13, 15. In particular, the distal limb of the longer contact element 24 overlies and is spring biased by the spring element portion 25. This is shown clearly in the cross-section view of FIG. 9C.

Second, as shown in FIGS. 9 A and B, a location near the end of the strip 40 is inserted into the slot 34 of the section 10A and guided to have its end portion extending below the shorter contact element 22 of the LED 20. Again this is most clearly seen in the cross-section view of FIG. 9C.

Thirdly, as shown in FIG. 10, the two button cell batteries 31, 32 are positioned one after the other into the same section 10A. It is simple to ensure that the first battery 31 is located against the first LED contact element 22, with the end portion of the strip 40 extending therebetween, and that the second battery 32 is located between the first battery 31 and the second LED contact element 24. The spring element 25 acting on the second contact element 24 ensures that these batteries 31, 32 and the strip end portion are held in place correctly and firmly as soon as they are positioned. The upstand 41 of the inner part 12 in the section 10A, beyond the 180° diameter of the batteries 31, 32 also ensures their retention during this step of the assembly process.

The housing 10 is then closed, as shown in FIG. 11, by swinging over the mating section 10B about the hinge 16 and engagement of the respective latch formations 26, 27, 29 with the complimentary recesses 28, 39 of the respective mating sections 10A, 10B. As this is done, the strip 40 should, if necessary, be guided to locate through the corresponding slot 34 of the section 10B before the clip connection is completed. In other words, it should be ensured that the strip/pull tab 40 is not trapped between the sections 10A, 10B and will be removable by way of the mated slots (or slot) 34 in the housing at a later stage.

The finished assembly is shown in all of FIGS. 12 to 15. The device is then ready for mounting inside a balloon in the manner previously explained.

The foregoing is illustrative and not limitative of the scope of the invention. Many variations in detail of the design are possible in other embodiments within the scope of the appended claims. In particular, the material chosen for the inner and outer parts of the housing may differ and may be any suitable plastics or other material. The detailed configuration of the various components may vary. In other embodiments the housing may not be in one piece, nor have mating sections. Also the light source may be other than an LED. In a slightly modified version of the device, the outer casing may include an additional flap, maybe of just 1 mm width, extending from the mating edge of either the housing section 10A or the housing section 10B, particularly in the region where these abut over the LED, to overlap the adjacent edge of the other housing section, so as to ensure that there is no gap and the LED at least is fully enclosed and protected.

The invention claimed is:

1. An illumination device for mounting inside a balloon formed by a wall of flexible material which is at least partially transparent or translucent, the illumination device comprising a housing, and a light source and a battery power source for the light source mounted within the housing, wherein the housing is provided as an inner part of a first plastics material in which the battery power source is housed and an outer casing of a second plastics material which at least partially surrounds the inner part and provides a cover for the light source, wherein the second plastics material is transparent and is resiliently deformable, and wherein the housing is provided as at least one co-moulding of the first plastics material and the second plastics material.

2. An illumination device as claimed in claim 1 wherein the light source has first and second connector members and at least one of said first and second connector members projects to contact a respective terminal of the battery power source, and the first plastics material includes an integrally formed spring element portion which is configured and arranged to hold at least one of said first and second connector members and/or the battery power source under spring bias to maintain contact there between.

3. An illumination device as claimed in claim 2 wherein the housing is provided as a one-piece unit.

4. An illumination device as claimed in claim 1 wherein the housing has an outward projection in the form of a pin with a neck and an enlarged head whereby it is attachable to the wall of the balloon by engagement from outside by an attachment element such as a band or clip.

5. An illumination device as claimed in claim 4 wherein the projection is at least partially formed of the first plastics material as an extended portion of the inner part of the housing.

6. An illumination device as claimed in claim 1 wherein a removable strip of insulating material is initially arranged to have an end portion disposed directly between one of the first and second connector members and the respective terminal of the battery power source.

7. An illumination device as claimed in claim 6 wherein the housing is provided as two mating sections.

8. An illumination device as claimed in claim 7 wherein at least one of the mating sections has a slot extending from a mating edge through which the insulating strip passes to provide an externally accessible pull tab.

9. An illumination device as claimed in claim 1 wherein the housing is provided as two mating sections.

10. An illumination device as claimed in claim 9 wherein the two mating sections are hingedly connected to each other.

11. An illumination device as claimed in claim 9 wherein the two mating sections are connected by a hinge portion which is at least partially formed of the first plastics material as a portion of the inner part of the housing.

12. An illumination device as claimed in claim 9 wherein the mating sections are fastened together by at least one latch formation.

13. An illumination device as claimed in claim 12 wherein the at least one latch formation is formed of the first plastics material and provided integrally with the inner part of the housing.

14. An illumination device as claimed in claim 9 wherein the inner part of the first of the two mating sections is larger than the inner part of the second of the mating sections and is configured to accommodate more than half of the cross-sectional area of the battery power source which is housed in the mated inner part of the said mating sections.

15. An illumination device as claimed in claim 1 wherein the second plastics material has a co-efficient of restitution in the range of 0.4 to 0.6.

16. An illumination device as claimed in claim 1 wherein the second plastics material has a thickness in a range between 0.5 mm and 1.0 mm where it serves as an outer casing surrounding the inner part.

17. An illumination device as claimed in claim 1 wherein the second plastics material is a thermoplastics elastomer.

18. An illumination device as claimed in claim 17 wherein the second plastics material is an elastomeric alloy or a thermoplastic vulcanizate (TPV).

* * * * *